US005277045A

United States Patent [19]

Mahoney et al.

[11] Patent Number: 5,277,045

[45] Date of Patent: Jan. 11, 1994

[54] SUPERPLASTIC FORMING OF METALS AT TEMPERATURES GREATER THAN 1000 DEGREE C

[75] Inventors: Murray W. Mahoney, Camarillo; Clifford C. Bampton, Thousand Oaks, both of Calif.

[73] Assignee: Rockwell International Corp., Seal Beach, Calif.

[21] Appl. No.: 880,402

[22] Filed: May 8, 1992

[51] Int. Cl.[5] ..... B21D 26/02

[52] U.S. Cl. ..... 72/60; 72/709

[58] Field of Search ..... 72/58, 60, 709

[56] References Cited

U.S. PATENT DOCUMENTS

| | | | |
|---|---|---|---|
| 4,354,369 | 10/1982 | Hamilton | 72/60 |
| 4,420,958 | 12/1983 | Schulz et al. | 72/60 |
| 4,474,044 | 10/1984 | Leistner et al. | 72/60 |
| 4,901,552 | 2/1990 | Ginty et al. | 72/709 |
| 4,951,491 | 8/1990 | Lorenz | 72/709 |
| 4,984,348 | 1/1991 | Cadwell | 72/60 |

FOREIGN PATENT DOCUMENTS

| | | | |
|---|---|---|---|
| 2004410 | 11/1969 | France | 72/709 |
| 0025617 | 2/1977 | Japan | 72/60 |
| 0197021 | 8/1989 | Japan | 72/60 |
| 0210130 | 8/1989 | Japan | 72/709 |
| 0608588 | 5/1978 | U.S.S.R. | 72/60 |
| 0719753 | 3/1980 | U.S.S.R. | 72/60 |

*Primary Examiner*—David Jones

*Attorney, Agent, or Firm*—Terrell P. Lewis; Charles T. Silberberg

[57] ABSTRACT

A method and apparatus for effecting superplastic forming of metal workpieces at temperatures greater than 1000° C., wherein both oxidation and creep deformation of the tooling are minimized. The process is achieved by heating forming surfaces of ceramic forming dies to temperatures in excess of 1000° C., and using metal housings to impart high loading conditions to seal the workpiece within a chamber for superplastic forming. More specifically, the metal housings are used not only for load bearing purposes, but also for creating an evacuated chamber within which superplastic forming can take place. The ceramic dies, on the other hand, are positioned on opposing sides of the workpiece region to be superplastically formed, and are insulated from, while being contained within, the metallic dies. Once the region of the workpieces to be superplastically formed has attained the desired temperature, expansion gases are introduced into the workpieces region via appropriate means to facilitate superplastic expansion of the workpiece within the chamber formed between the metallic housings.

10 Claims, 1 Drawing Sheet

SUPERPLASTIC FORMING OF METALS AT TEMPERATURES GREATER THAN 1000 DEGREE C

BACKGROUND OF THE INVENTION

1. Field of the Invention

The present invention relates to methods and apparatus for superplastic forming of metals, and more particularly to novel means for effecting superplastic forming of metals at temperatures greater than 1000° C., while resisting oxidation and creep deformation ordinarily attendant conventional tooling.

2. Background of the Invention

For many years, it has been known that certain metals, such as titanium alloys, exhibit superplasticity within limited temperature ranges and strain rates. Superplasticity is the capability of a material to develop unusually high tensile elongations with a reduced tendency towards necking. Thus, when in a superplastic condition, the metal alloy exhibits low resistance to deformation and may be elongated with reduced thinning. This permits a sheet of such metal to be readily formed against dies to achieve desired shapes while maintaining a substantially uniform thickness in the finished part without any weak points.

Superplastic forming (SPF) may be performed in conjunction with diffusion bonding, a process in which the surfaces of facing metallic components are metallurgically joined through application of high temperatures and pressures sufficient to cause commingling of atoms at the junction of the surfaces.

Conventional superplastic forming (SPF) techniques are limited to temperatures below approximately 1000° C. This temperature restriction is due to excessive oxidation of parts and tooling components, as well as creep deformation of metallic dies when subjected to press loads during forming. In addition, a significant need has developed for SPF processes which can use temperatures up to approximately 1250° C. for fabrication of materials such as gamma titanium aluminide materials.

OBJECTS AND SUMMARY OF THE INVENTION

It is therefore a principal object of the present invention to provide a novel forming apparatus which will permit superplastic forming of metals at temperatures of up to 1250° C. while overcoming all the disadvantages and drawbacks of known superplastic forming apparatus.

Another object of the present invention is to provide an apparatus for performing superplastic forming of titanium aluminide materials while minimizing oxidation of the work and the tooling.

Still another object of the invention is to provide an apparatus, which includes ceramic forming dies, in which substantially zero load is applied to the ceramic dies during an SPF process carried out with the apparatus.

These and other objects and advantages are achieved with the apparatus of the invention which includes ceramic work-forming dies supported within a metallic forming-gas containment chamber. Facing surfaces of the dies are heated by appropriate heating means, and the thermal expansion differences between the dies and the containment chamber are accommodated by a layer of insulation disposed about the dies.

DETAILED DESCRIPTION OF THE INVENTION

Figure 1:
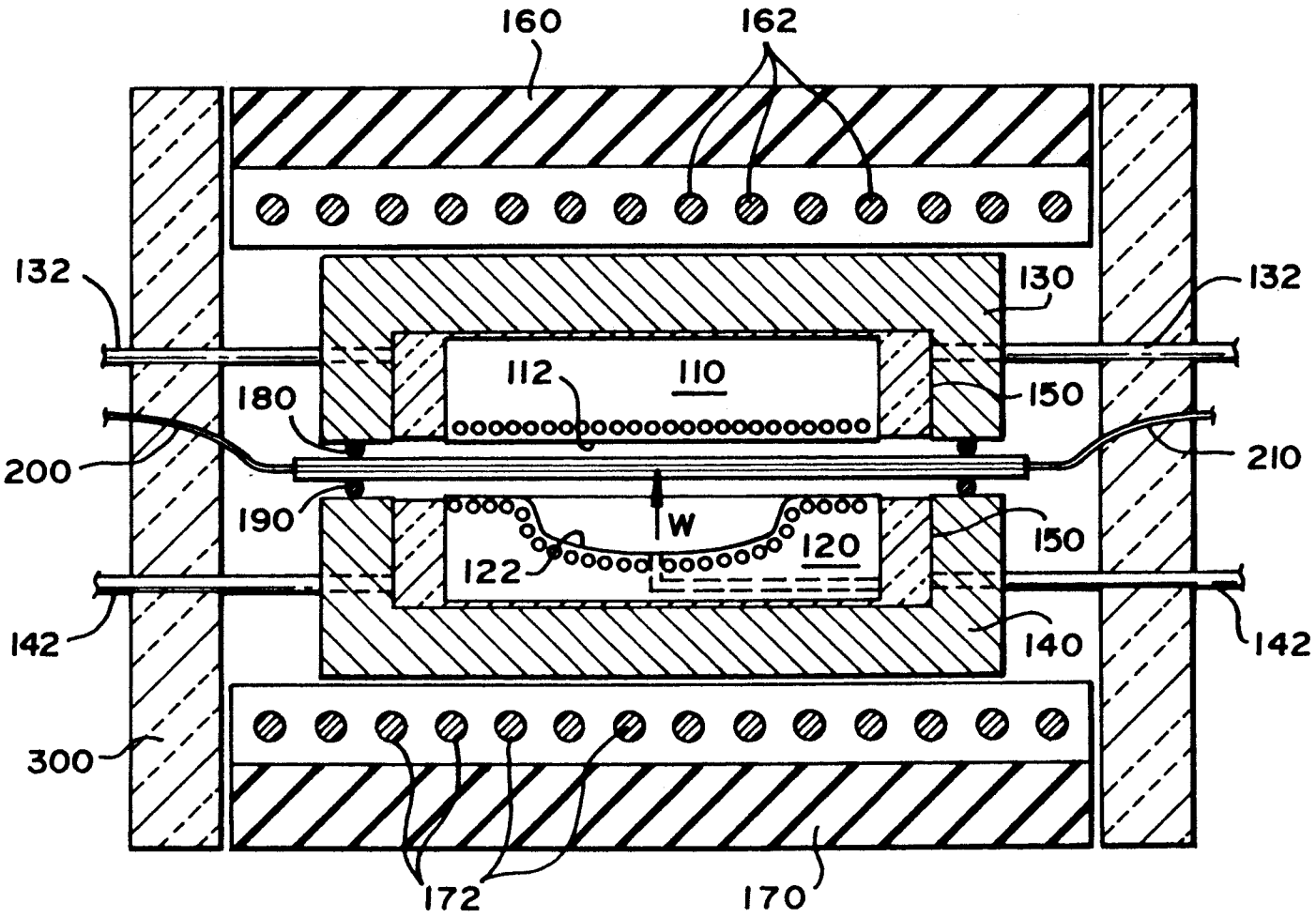
FIG. 1 shows a preferred embodiment of the apparatus of the present invention in aside sectional view.

Referring now to the accompanying Figure, the forming apparatus of the present invention, shown generally at 100, includes two ceramic forming dies 110, 120 each having a forming surface 112, 122 of a predetermined configuration between which the workpiece is to be formed. As shown by way of example in the Figure, the upper ceramic die is provided with a substantially planar forming surface 112, while the lower ceramic die is provided with a concave, dish-like configured surface 122. It is to be understood that almost any configuration can be given to the forming surfaces, and these configurations are to be determined with the ultimate post-formed shape in mind.

Ceramic dies are typically unable to sustain high non-uniform loads and there are no known methods of plumbing pressurized gas lines to large ceramic dies. Metallic dies are limited to temperatures below 1000° C. (in air). On the other hand, when superplastic forming is carried out with metallic dies at these elevated temperature levels, the combination of high press loads and high temperatures results in excessive oxidation of the parts and tooling and creep deformation of the metallic dies.

The inventors have solved these problems by providing ceramic forming dies 110 and 120 in hot locations where the temperatures exceed 1000° C., while minimizing the load by using metallic dies in high load locations and providing gas seals in the metallic regions. The superplastic forming system shown in FIG. 1 is an example of an apparatus which will accomplish this separation of loads and temperature by using localized heating and insulating while using ceramic materials for the forming dies and metals for gas containment purposes.

As shown, each of the ceramic dies 110, 120 is provided with an array of resistance heaters 114, 124 at a location near the exposed forming face of the respective die. These arrays of resistance heaters 114, 124 coact with one another to provide intense localized heating when the apparatus is used to perform an SPF operation. Alternatively, a combination of integral heaters in the lower die along with a radiant heating system, such as an array of quartz lamps, in the upper die can be used.

Each of the upper and lower ceramic dies are contained within respective upper and lower metallic housings 130 and 140. Each metal housing is formed with a substantially rectangular or circular well within which a respective ceramic die is received. An insulation barrier 150 is provided around the outer surfaces of the upper and lower ceramic dies, and separates the outer surfaces of the dies from the inner surfaces of the metallic housings. The thickness and density of this insulation barrier establishes the temperature gradient between the ceramic dies and the metallic housing. Additional insulation can be achieved by increasing the thickness of the nonheated regions of the ceramic dies. A soft insulation, such as kao wool, should be placed between the metal and ceramic components to accommodate the differences in thermal expansion.

Conventional gas inlets and outlets 132, 142 (as well as appropriate valving [not shown]) are provided in each of the upper and lower metallic containers for conveying forming gas into the chamber formed between the upper and lower containers during the forming process.

Positioned above and below the metallic containers 130, 140 are upper and lower ceramic insulators 160, 170. Each of the ceramic insulators is outfitted with an array of resistance heaters 162, 172 for heating the respective upper and lower metallic housings. This additional heating capability may or may not be necessary to reach desired temperatures, but adds an additional capability for controlling the temperature gradient.

Soft metallic seals 180, 190 are provided to interface with the extreme regions of the upper and lower surfaces of workpiece W and the respective lower and upper surfaces of the housings 130 and 140 to seal the workpiece W from the respective lower and upper mating surfaces of the metallic housings. In the Figure, the lower ceramic die is shown as being provided with a contoured forming surface 122. It is to be understood that, if desired, both ceramic dies could be provided with contoured forming surfaces, whether identical or otherwise.

Finally, the apparatus also includes small diameter capillary tubes 200, 210 of the kind typically used for supplying expansion gases to the workpiece W to effect superplastic forming.

Insulating means 300 shown in the Figure is provided about the forming apparatus herein described to aid in containing the heat in the forming chamber and to protect the operators of this equipment.

Use of this apparatus obtains several outstanding benefits not obtainable with the currently-known apparatus.

First, environmental control is achieved in the forming chamber by insuring a sealed interface between the workpiece W and the facing metallic housing surfaces, and purging the so-defined volume with an inert gas. Environmental control in the forming chamber is important insofar as it prevents oxidation of the workpiece during forming.

For leak tight sealing at low to moderate temperatures, it may be necessary to add a soft wire or band (e.g., Pt or Ti) around the circumference of the workpiece. This may be necessary because below the ductile to brittle transition temperature, i.e., the temperature below which the workpiece cannot sustain a load because of low ductility, the workpiece W can become relatively brittle and not sustain compressive loads. This added band deforms under low press pressure causing metal flow and subsequently provides a leak tight containment. Gas pressure inside the containment is only slightly above atmospheric pressure during purging and thus will not cause blowout of the soft seal.

Second, as described above, localized heating of the workpiece and the forming dies can be attained without subjecting either to the inordinately high press loads usually encountered in known superplastic forming apparatus.

Third, the system according to the present invention provides localized heating of the workpiece and the forming dies in such a manner as to develop a temperature gradient with the forming dies and workpiece reaching temperatures necessary for superplastic forming, while the metallic housings of which the containment chamber is formed is maintained at temperatures significantly less than the forming temperatures. The magnitude of the temperature gradient is determinable as a function of the type and thickness of insulation placed between the ceramic dies and the metallic housings. This gradient results in reduced oxidation and creep distortion of the metallic containment housings.

Fourth, with the system of the present invention, press loads for sealing purposes are restrictively applied to the metallic containment chamber. Since this chamber is insulated from the forming dies, temperatures of the metallic housings which together define the chamber are maintained far below 1000° C. (on the order of 200° C. to 400° C.) and the metallic portion of the system will perform in a manner similar to the conventional SPF tooling. If the temperatures of the metallic housings are maintained below 1000° C., the deformation and oxidation of the housings will be significantly less than with conventional SPF tooling.

Fifth, with the system as shown in FIG. 1, virtually no load is applied to the ceramic forming dies. The load on the ceramic forming dies is only that necessary to gas pressure form the part. These pressures are usually less than 1000 psi, and can be sustained by ceramic materials at these elevated temperatures, especially since the loads are pneumatic only and thus avoid non-uniform or point loading.

Sixth, one of the greatest difficulties for use of ceramic dies in superplastic application is the inability to plumb necessary gas management capabilities into the interior of the die. In the system disclosed in the Figure, all the plumbing for gas management (including, for example, the gas inlet, gas outlet and purge lines) is attached to the metallic containment housings via conventional mechanical connections.

While certain representative embodiments and details have been shown for the purpose of illustrating the invention, it will be apparent to those skilled in this art that various changes and modifications may be made therein without departing from the spirit or scope of this invention.

What we claim is:

1. An apparatus for superplastic forming of a metallic workpiece at temperatures greater than 1000° C., comprising:

upper and lower metallic housings, an upper ceramic forming die contained within the upper housing, and a lower ceramic forming die contained within the lower housing, each die having a forming surface, means for insulating each forming die from its housing, press means for urging said housings toward one another to form a sealed container for said workpiece defined between facing forming surfaces of said dies, each said forming die including heating means, disposed close to the forming surface of said each die, for elevating the temperature of said workpiece to at least 1000° C., whereby when said temperature of said workpiece attains said elevated temperature, superplastic forming of said workpiece can be carried out.

2. The apparatus of claim 1, and further including means for activating the heating means of at least one of said dies.

3. The apparatus of claim 2, wherein said heating means of both said dies are activated simultaneously.

4. The apparatus of claim 1, and further including a retort surrounding said housings and said dies, said retort being sealed and evacuated to form a controlled environment in which said superplastic forming can be carried out without oxidation of said workpiece.

5. The apparatus of claim 1, and further including gas conveying means, interconnected with said housings and a source of pressurized gas, to produce a controlled pressure differential above and below the metallic workpiece, whereby gas pressure forming of said workpiece between said facing die surfaces takes place.

6. The apparatus of claim 1, wherein said press means further includes seal means disposed between facing surfaces of said housings, said seal means coacting with opposing sides of said workpiece to delimit upper and lower gas-tight forming chambers containing said ceramic dies.

7. A system of components for performing superplastic forming of metal sandwich workpieces at elevated temperatures, comprising:

first and second ceramic forming dies having forming surfaces disposed in facing relationship, first and second metal housings, each housing having a recess for housing a respective die, means for controlling temperature gradients between each said housing and said respective die, means for heating said forming surfaces of said dies, and said metal sandwich workpieces, to superplastic forming temperatures in excess of 1000° C., means for urging said housings toward one another with a force sufficient to delimit a closed chamber between one surface of said workpiece and a respective adjacent housing and die, means for evacuating each of said closed chambers, and means for introducing pressurized gas into said sandwich workpiece when said dies are heated to said superplastic forming temperatures.

8. The system of components of claim 7, wherein one of said ceramic forming dies includes gas conveying means connected with tank means outside said housing in which said forming die is disposed.

9. The system of components of claim 7, wherein said means for controlling temperature gradients includes insulation means disposed between each said ceramic die and its respective housing.

10. The system of components of claim 7, wherein said means for heating said forming surfaces of said dies comprises an array of heating elements adjacent a region of each forming surface disposed closest to said workpiece.

* * * * *